US010061250B2

(12) United States Patent
Nii et al.

(10) Patent No.: US 10,061,250 B2
(45) Date of Patent: Aug. 28, 2018

(54) IMAGE FORMING APPARATUS AND PHOTOCONDUCTOR EVALUATION METHOD

(71) Applicants: Daisuke Nii, Shizuoka (JP); Noriyasu Saito, Shizuoka (JP); Kazuhiro Egawa, Shizuoka (JP)

(72) Inventors: Daisuke Nii, Shizuoka (JP); Noriyasu Saito, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/805,182

(22) Filed: Nov. 7, 2017

(65) Prior Publication Data

US 2018/0150013 A1 May 31, 2018

(30) Foreign Application Priority Data

Nov. 30, 2016 (JP) ..... 2016-232894

(51) Int. Cl.
*G03G 15/00* (2006.01)

(52) U.S. Cl.
CPC ..... *G03G 15/55* (2013.01); *G03G 15/505* (2013.01)

(58) Field of Classification Search
CPC ..... G03G 15/55; G03G 15/505
See application file for complete search history.

(56) References Cited

U.S. PATENT DOCUMENTS 7,263,299 B2 * 8/2007 Nagamochi ..... G03G 15/5037 399/26
8,798,487 B2 * 8/2014 Asano ..... G03G 15/5037 399/26
2009/0208246 A1 8/2009 Kami
2010/0119260 A1 5/2010 Egawa et al.
(Continued)

FOREIGN PATENT DOCUMENTS

JP 11-194554 7/1999
JP 2008-026794 2/2008
(Continued)

OTHER PUBLICATIONS

U.S. Appl. No. 15/601,220, filed May 22, 2017, Toshihiro Ishida, et al.

*Primary Examiner* — Gregory H Curran
(74) *Attorney, Agent, or Firm* — Oblon, McClelland, Maier & Neustadt, L.L.P.

(57) ABSTRACT

An image forming apparatus includes a photoconductor, a charger, an exposure device, a transfer device, a first and a second surface voltmeter, and a processor. At the first rotation of the photoconductor, the charger charges a charge area on the photoconductor, the exposure device exposes a part of an exposure area in an axial direction of the photoconductor, and the transfer device charges an exposed and unexposed area. At the second rotation, the charger charges the charge area, and the exposure device exposes the exposed and unexposed area at the first rotation. After the exposure at the second rotation, the first surface voltmeter measures a surface potential V1 of the unexposed area at the first rotation, and the second surface voltmeter measures a surface potential V2 of the exposed area at the first rotation. The processor evaluates a life of the photoconductor based on the surface potentials V1 and V2.

10 Claims, 7 Drawing Sheets

(56) References Cited

U.S. PATENT DOCUMENTS

| | | | |
|---|---|---|---|
| 2010/0124712 | A1 | 5/2010 | Egawa et al. |
| 2010/0172670 | A1 | 7/2010 | Ohshima et al. |
| 2010/0232831 | A1 | 9/2010 | Fujiwara et al. |
| 2010/0316423 | A1 | 12/2010 | Kami et al. |
| 2011/0076057 | A1 | 3/2011 | Kami et al. |
| 2011/0200924 | A1 | 8/2011 | Kami et al. |
| 2012/0008984 | A1 | 1/2012 | Kami et al. |
| 2012/0183310 | A1 | 7/2012 | Asano et al. |
| 2013/0243506 | A1 | 9/2013 | Ikuno et al. |
| 2013/0244150 | A1 | 9/2013 | Toshine et al. |
| 2014/0064810 | A1 | 3/2014 | Iwamoto et al. |
| 2014/0199620 | A1 | 7/2014 | Ishida et al. |
| 2014/0234763 | A1 | 8/2014 | Sugino et al. |
| 2015/0168856 | A1 | 6/2015 | Kurimoto et al. |
| 2015/0227063 | A1 | 8/2015 | Kami et al. |
| 2015/0309430 | A1 | 10/2015 | Nii et al. |
| 2016/0139517 | A1 | 5/2016 | Ishida et al. |
| 2016/0161871 | A1 | 6/2016 | Asano et al. |
| 2016/0274475 | A1 | 9/2016 | Eguchi et al. |
| 2016/0327877 | A1 | 11/2016 | Kurimoto et al. |
| 2016/0334720 | A1 | 11/2016 | Ishida et al. |
| 2017/0153559 | A1 | 6/2017 | Asano et al. |
| 2017/0307988 | A1 | 10/2017 | Asano et al. |

FOREIGN PATENT DOCUMENTS

| | | | | |
|---|---|---|---|---|
| JP | 2009092709 | A | * | 4/2009 |
| JP | 2012-150162 | | | 8/2012 |
| JP | 2014-139614 | | | 7/2014 |

* cited by examiner

IMAGE FORMING APPARATUS AND PHOTOCONDUCTOR EVALUATION METHOD

CROSS-REFERENCE TO RELATED APPLICATION

This patent application is based on and claims priority pursuant to 35 U.S.C. § 119 to Japanese Patent Application No. 2016-232894, filed on Nov. 30, 2016, in the Japanese Patent Office, the entire disclosure of which is hereby incorporated by reference herein.

BACKGROUND

Technical Field

Aspects of this disclosure relate to an image forming apparatus and a photoconductor evaluation method employed by the image forming apparatus.

Background Art

Various types of electrophotographic image forming apparatuses are known, including copiers, printers, facsimile machines, or multifunction peripherals having two or more of the foregoing capabilities.

An image forming process executed by the electrophotographic image forming apparatus involves charging a photoconductor, forming an electrostatic latent image on the charged photoconductor, developing the electrostatic latent image on the photoconductor with a developer such as toner to obtain a visible image, transferring a developed image onto a recording member by a transfer device, and fixing the developed image on the recording member by a fixing device that use pressure and heat.

The surfaces of the photoconductors installed in the image forming apparatuses are abraded by frictional sliding of a cleaning blade and the developer at a development portion, and the photosensitive layer of the photoconductor is fatigued by repetitive charging and discharging, which results in deterioration of the photoconductors over time. The deterioration of the photoconductor makes it easy to leave a previous image on the photoconductor and causes an abnormal image such as an afterimage. The afterimage is a gray image of the previous image appearing in a following image. The photoconductor that produces defective images beyond tolerance because of the deterioration over time is identified as a photoconductor that has reached the end of its working life, and has worn out. Typically, the photoconductor is replaced before it is worn out.

The time when the photoconductor is replaced is, for example, set as follows. An endurance test using a test machine that has the same configuration as a target machine under a standard usage environment and standard usage conditions provides a life index value such as a total number of output images, a total cumulative number of rotations of photoconductor, etc. at which the photoconductor has worn out. With regard to the photoconductor installed in the target machine, a replacement timing of the photoconductor is set based not on individual image forming apparatuses but on the life index value uniformly.

However, when the photoconductor wears out (that is, a time when the photoconductor has come to the end of life) greatly depends on the environment and usage condition of each image forming apparatus. Therefore, if the replacement timing of the photoconductor is fixed uniformly, there is a danger that the photoconductor has worn out before the replacement timing.

When the photoconductor has worn out before its replacement timing, a serious defective image may be outputted. In such a case, a user cannot help printing a product again after replacing the photoconductor.

On the other hand, the replacement timing of the photoconductor may he set at a sufficiently early timing not to reach the end of life before the photoconductor replacement timing arrives under any usage environment and usage conditions. However, as a result, a number of photoconductors are replaced before being fully used up, which is disadvantageous in terms of effective utilization of resources and economy.

Therefore, there is a need for an effective method for evaluating the life of the photoconductor in each image forming apparatus. In the method, the image forming apparatus detects deterioration of the photoconductor in use, and determines whether the photoconductor is worn out (that is, the photoconductor reaches the end of life) based on a detected result (hereinafter called lifetime determination) or predicts when the photoconductor will be worn out based on a detected result (hereinafter called lifetime prediction).

SUMMARY

This specification describes an improved image forming apparatus, which, in one illustrative embodiment, includes a rotatable photoconductor, a charger, an exposure device, a transfer device, a first surface voltmeter, a second surface voltmeter and a processor. The charger charges a charge area on a surface of the photoconductor. The exposure device forms an electrostatic latent image on an exposure area on the surface of the photoconductor after the charger charges the surface of the photoconductor. The transfer device transfers a toner image obtained by developing the electrostatic latent image onto a recording member. The first surface voltmeter to measure a first surface potential of the photoconductor. The second surface voltmeter measures a second surface potential of the photoconductor, and is disposed at a position different from a position of the first surface voltmeter in an axial direction of the photoconductor. The processor controls the photoconductor to be rotated at a predetermined timing. At the first rotation of the photoconductor, the processor controls the charger to charge the charge area, the exposure device to expose a part of the exposure area in the axial direction of the photoconductor, and the transfer device to charge an exposed area and an unexposed area on the photoconductor. At the second rotation of the photoconductor, the processor controls the charger to charge the charge area, and the exposure device to expose the exposed area and the unexposed area at the first rotation of the photoconductor. After the exposure at the second rotation, the processor controls the surface voltmeter to measure a surface potential V1 of an unexposed area of the photoconductor at the first rotation by the first surface voltmeter, and a surface potential V2 of the exposed area of the photoconductor at the first rotation by the second surface voltmeter. The processor evaluates a life of the photoconductor based on the surface potential V1 and the surface potential V2.

This specification further describes an improved photoconductor evaluation method that includes following processes. At the first rotation of the photoconductor at a predetermined timing, the processes include charging a charge area on a surface of the photoconductor to a first polarity, exposing a part of an exposure area in an axial direction of the photoconductor to form an electrostatic latent image after charging the charge area on the surface of the photoconductor, and charging an exposed area and an unexposed area of the exposure area to a second polarity that is opposite the first polarity. At the second rotation of the photoconductor, the processes include charging the charge area on the surface of the photoconductor to the first polarity, exposing the exposed area and the unexposed area at the first rotation of the photoconductor, and measuring a first surface potential of the unexposed area on the photoconductor at the first rotation and a second surface potential of the exposed area on the photoconductor at the first rotation. The processes include evaluating a life of the photoconductor based on the first surface potential and the second surface potential.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

DETAILED DESCRIPTION

Figure 1:
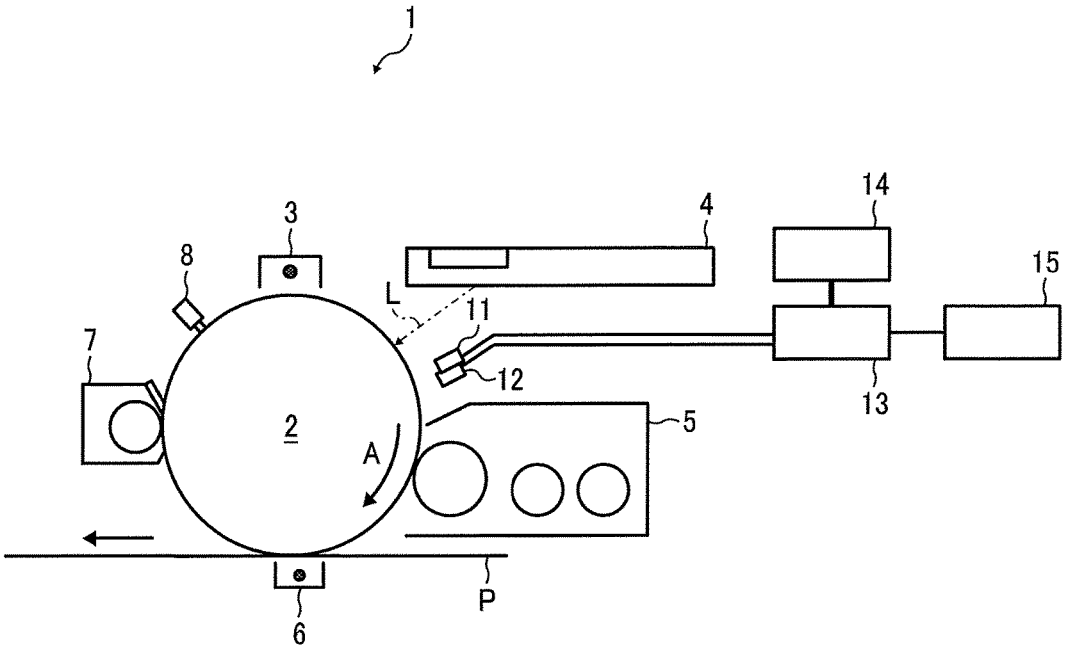
FIG. 1 is a schematic view of an image forming apparatus according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

The configurations related to the present disclosure are described based on embodiments illustrated in the accompanied drawings from FIGS. 1 to 9.

Referring now to the drawings, wherein like reference numerals designate identical or corresponding parts throughout the several views thereof, and particularly to FIG. 1, an image forming apparatus 1 employing electrophotography, according to an embodiment of the present disclosure is described.

First Embodiment

The image forming apparatus 1 according to the present embodiment includes a rotatable photoconductor 2 having a surface including a charge area and an exposure area, a charger 3 to charge the charge area on the surface of the photoconductor 2, an exposure device 4 to form an electrostatic latent image on the exposure area on the surface of the photoconductor 2 after the charger 3 charges the charge area on the surface of the photoconductor 2, a transfer device 6 to transfer a toner image obtained by developing the electrostatic latent image onto a recording medium (e.g., a transfer sheet P), and surface voltmeters to measure a surface potential of the photoconductor 2. The surface voltmeters include a first surface voltmeter 11 and a second surface voltmeter 12 provided at a position different from a position of the first surface voltmeter 11 in an axial direction of the photoconductor 2. At a predetermined timing when the surface voltmeters measure the surface potential of the photoconductor 2, when the photoconductor 2 makes a first rotation, the charger 3 charges the charge area of the photoconductor 2. The charge area is an area where the charger 3 charges the photoconductor 2 in image formation. After the charger 3 charges the photoconductor 2, the exposure device 4 exposes a part of the exposure area in the axial direction of the photoconductor 2. The exposure area is an area where the exposure device 4 exposes the photoconductor 2 in image formation. After the exposure device 4 exposes a part of the exposure area, the transfer device 6 applies a transfer charge to the exposed area that is a part of the exposure area in the axial direction of the photoconductor 2 and the unexposed area. Subsequently, when the photoconductor 2 rotates, that is, at a second rotation, the charger 3 charges the charge area of the photoconductor 2, and the exposure device 4 exposes an unexposed area where the exposure device 4 does not expose the photoconductor 2 at the first rotation and an exposed area where the exposure device 4 exposes the photoconductor 2 at the first rotation. At this time, the exposure device 4 may expose the entire exposure area. After the exposure device 4 exposes the photoconductor 2 at the second rotation, the first surface voltmeter 11 measures a surface potential V1 at the unexposed area where the exposure device 4 does not expose the photoconductor 2 at the first rotation, and the second surface voltmeter 12 measures a surface potential V2 at the exposed area where the exposure device 4 exposes the photoconductor 2 at the first rotation. Additionally, the image forming apparatus 1 according to the present embodiment includes a processor 13 to evaluate a life of the photoconductor 2 based on the surface potential V1 and the surface potential V2.

Structure of the Image Forming Apparatus 1

FIG. 1 is a schematic view illustrating the image forming apparatus 1 according to the present embodiment. The image forming apparatus 1 includes a drum-shaped photoconductor 2 rotatable in a direction of rotation A. Around the photoconductor 2, the image forming apparatus 1 also includes the charger 3 to charge the charge area on the surface of the photoconductor 2 uniformly, the exposure device 4 to expose the charged surface of the photoconductor 2 with a laser beam L and form the electrostatic latent image, a developing device 5 to develop the electrostatic latent image with toner, the transfer device 6 to transfer the toner image obtained by developing from the photoconductor 2 onto a recording medium (e.g., a transfer sheet P), a cleaning device 7 to remove residual toner from the surface of the photoconductor 2 after transferring, and a discharger 8 to remove residual charge on the surface of the photoconductor 2, which are provided in an order described above along the direction of rotation A of the photoconductor 2.

Additionally, the image forming apparatus 1 includes the first surface voltmeter 11 and the second surface voltmeter 12 as the surface voltmeters that measure the surface potential of the photoconductor 2 and are located between the exposure device 4 and the developing device 5 in the direction of rotation A of the photoconductor 2. The first surface voltmeter 11 and the second surface voltmeter 12 are located at a same position in a circumferential direction of the photoconductor 2 and at different positions in the axial direction of the photoconductor 2. The following explanation describes a measurement result of the surface potential by the first surface voltmeter 11 as the surface potential V1 and a measurement result of the surface potential by the second surface voltmeter 12 as the surface potential V2.

Additionally, the image forming apparatus 1 includes the processor 13 to evaluate the life of the photoconductor 2, a memory 14, and a notification device 15.

The processor 13 to evaluate the life of the photoconductor 2 receives readings from the first surface voltmeter 11 and the second surface voltmeter 12 and evaluates the life of the photoconductor 2 based on the readings from the first surface voltmeter 11 and the second surface voltmeter 12. The processor 13 determines whether the photoconductor 2 has already reached its life (lifetime determination) and predicts a remaining life of the photoconductor 2 (lifetime prediction).

The memory 14 stores information necessary to evaluate the life of the photoconductor 2, such as aging variation data, described later in detail. When the processor 13 evaluates the life of the photoconductor 2, the processor 13 reads the necessary data in the memory 14.

The notification device 15 is, for example, a control panel of the image forming apparatus 1 and a display control unit of the control panel, and receives an evaluation result from the processor 13 that evaluates the life of the photoconductor 2. The notification device 15 displays the evaluation result from the processor 13, for example, a fact that the photoconductor 2 has already reached its life or a time when the photoconductor 2 will reach the end of life, on the control panel.

Image Forming Process

Next, image forming process performed by the image forming apparatus 1 is described. Firstly, an image reading device of the image forming apparatus 1 reads an original document and outputs original image data. Alternatively, outer peripheral machines such as a computer make and output the original image data. An image processor of the image forming apparatus 1 receives the original image data and executes a suitable image processing.

The image processor generates an input image signal and inputs the input image signal to the exposure device 4. The exposure device 4 modulates a laser beam L based on the input image signal. The exposure device 4 irradiates the surface of the photoconductor 2 charged to a minus polarity by the charger 3 with the laser beam L modulated based on the input image signal. The laser beam L irradiated on the surface of the photoconductor 2 forms the electrostatic latent image on the photoconductor 2 corresponding to the input image signal.

The developing device 5 develops the electrostatic latent image formed on the photoconductor 2 with toner to form in the toner image on the photoconductor 2. The toner image formed on the photoconductor 2 is conveyed along the direction of rotation A of the photoconductor 2 to the transfer device 6 arranged facing the photoconductor 2.

On the other hand, the transfer sheet P is fed from a sheet feeder to a transfer area between the photoconductor 2 and the transfer device 6. A transfer bias of plus polarity is applied to the transfer device 6. The transfer bias works in the transfer area to transfer the toner image on the photoconductor 2 onto the transfer sheet P. The transfer sheet P on which the toner image is transferred is conveyed to a fixing device provided at a subsequent stage of a conveying path, and applied heat and pressure. The toner image is fixed on the transfer sheet P, and the transfer sheet P is discharged outside the image forming apparatus 1.

The cleaning device 7 removes an adhered substance such as residual toner remaining on the surface of the photoconductor 2 after transfer of the toner image onto the transfer sheet P. The discharger 8 removes residual charge on the surface of the photoconductor 2. Thus, one image forming process is completed. The charging polarity of the charger 3 and the transfer bias may be reversed depending on the material of the photoconductor 2.

Photoconductor Evaluation

While the above-described image formation is repeated tens of thousands of or millions of times, the photoconductor 2 deteriorates by various kinds of damage. As described above, the deterioration of the photoconductor 2 makes it easy to leave the previous image on the photoconductor 2, causing the abnormal image called as the afterimage. The afterimage is the gray image of the previous image appearing in a following image.

The afterimage includes a positive afterimage and a negative afterimage. In an image of the positive afterimage, a portion on the photoconductor 2 exposed by the exposure device 4 after charging by the charger 3 in the immediately preceding image forming (an exposure portion, the exposed area) becomes darker than a portion on the photoconductor 2 not exposed by the exposure device 4 after charging by the charger 3 in the immediately preceding image forming (a non-exposure portion, the unexposed area) in a next image formation. In an image of the negative afterimage, the exposure portion becomes lighter than the non-exposure portion.

The present disclosure detects an occurrence of the afterimage as follows. Two surface voltmeters are set at different positions on the photoconductor 2 in the axial direction. At the predetermined timing, when the photoconductor 2 makes the first rotation, the charger 3 charges the charge area on the photoconductor 2, the exposure device 4 exposes a part of the exposure area in the axial direction of the photoconductor 2, and the transfer device 6 applies the transfer charge to the exposed area (the exposure portion) where the exposure device 4 exposes the photoconductor 2 at the first rotation and the unexposed area (the non-exposure portion) where the exposure device 4 does not expose the photoconductor 2 at the first rotation. The transfer device may apply the transfer charge to the transfer area.

Subsequently, when the photoconductor 2 makes the second rotation, the charger 3 charges the charge area of the photoconductor 2, the exposure device 4 exposes the exposed area (the exposure portion) and the unexposed area (the non-exposure portion) of the photoconductor 2. The exposure device 4 may expose the entire exposure area. After the exposure device 4 exposes the photoconductor 2 at the second rotation, one surface voltmeter (the first surface voltmeter 11) measures the surface potential V1 at the unexposed area (the non-exposure portion) where the exposure device 4 does not expose the photoconductor 2 at the first rotation. Another surface voltmeter (the second surface voltmeter 12) measures the surface potential V2 at the exposed area (the exposure portion) where the exposure device 4 exposes the photoconductor 2 at the first rotation. It is to be noted that "the first rotation" and "the second rotation" in the present disclosure mean the first rotation and the second rotation of the photoconductor 2 at the predetermined timing when the surface voltmeters measure the surface potentials V1 and V2 to evaluate the life of the photoconductor 2. At the predetermined timing, the photoconductor 2 has already rotated a predetermined number of times, cumulatively. The predetermined timing is described later.

It is possible to evaluate the afterimage caused in the axial direction of the photoconductor 2 quantitatively based on a difference value ΔV between the potential at the unexposed area and the potential at the exposed area in the axial direction of the photoconductor 2. That is, the afterimage occurs when the difference value ΔV is greater than or equal to an upper limit value, that is, a reference value for life determination ΔVmax.

In the image forming apparatus 1 according to the present embodiment, after the surface voltmeters measure the surface potential V1 and the surface potential V2, respectively, the processor 13 calculates the difference value ΔV, an absolute value of a difference value between the surface potential V1 and the surface potential V2 (that is also called |V1−V2|), and performs the lifetime determination of the photoconductor 2 or the lifetime prediction of the photoconductor 2 based on the difference value ΔV.

Figure 2:
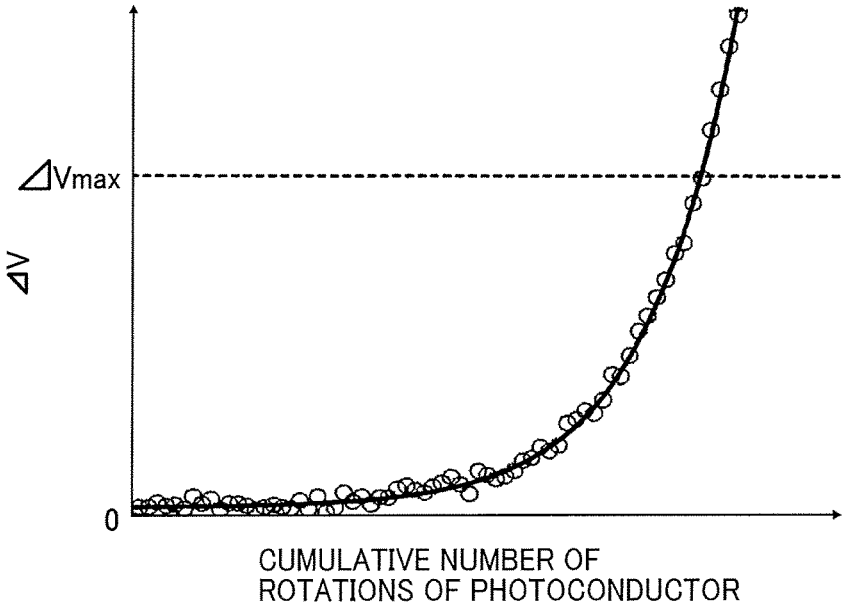
FIG. 2 is a graph illustrating a relation between the cumulative number of rotations of a photoconductor and a standard difference value ΔV in a standard usage environment and under standard usage conditions.

FIG. 2 is a graph illustrating a relation between the cumulative number of rotations of the photoconductor 2 and the standard difference value ΔV in a standard usage environment and under standard usage conditions. FIG. 2 illustrates aging variation of the standard difference value ΔV in the standard usage environment and under the standard usage conditions until the photoconductor 2 has come to the end of life, which is called aging variation data and stored in the memory 14.

As described above, the surface voltmeters obtain the surface potential V1 and the surface potential V2 at the predetermined timing. The processor 13 that evaluates the life of the photoconductor 2 calculates the difference value ΔV between the surface potential V1 and the surface potential V2 and compares the difference value ΔV and a reference value for life determination ΔVmax that is set as a threshold value to determine the life of the photoconductor 2. By this comparison, when the difference value ΔV is equal to or greater than the reference value for life determination ΔVmax, the processor 13 determines that the photoconductor 2 has come to the end of life. In addition, when the processor 13 determines that the difference value ΔV is less than the reference value for life determination ΔVmax, the processor 13 refers to the aging variation data in the memory 14 and predicts the time when the photoconductor 2 will come the end of life based on the difference value ΔV and the aging variation data.

The transfer device 6 can switch setting between constant current control and constant voltage control, and set the control arbitrarily. A transfer condition in the transfer device 6 can be arbitrarily set. That is, the transfer condition can be changed from the transfer condition during image formation. As a specific setting method, for example, there is a following method. A condition in which no afterimage occurs when the cumulative number of rotations n is zero but the afterimage is very likely to occur is previously obtained, and measurement is always performed under the condition.

The exposure device 4 can arbitrarily set an exposure range at the first rotation in the axial direction of the photoconductor 2. The exposure device 4 can arbitrarily set an exposure amount. Preferably, the exposure amount at the second rotation is less than the exposure amount at the first rotation to increase detection sensitivity of the afterimage.

An exposure condition of the exposure device 4 may be changed from the exposure condition during image formation. As a specific setting method, a condition in which no afterimage occurs when the cumulative number of rotations n is zero but the afterimage is very likely to occur is previously obtained, and measurement is always performed under the condition.

Preferably, the exposure device 4 changes the exposure ranges at the first rotation in the axial direction of the photoconductor 2, and makes a plurality of the exposure ranges. The surface voltmeters obtain the plurality of the surface potential V1 and the surface potential V2, respectively. The processor 13 calculates the difference values ΔV corresponding to the plurality of the exposure ranges.

The predetermined timing for the lifetime determination and the lifetime prediction may be set at any timing but preferably before starting a print job, for example. Because, when the measurement for the lifetime determination and the lifetime prediction is conducted between print jobs or immediately after a print job, the degree of short-term deterioration of the photoconductor 2 accumulated during the print job depends on the content of the print job before the measurement, which tends to cause an error in the measurement result.

Figure 3:
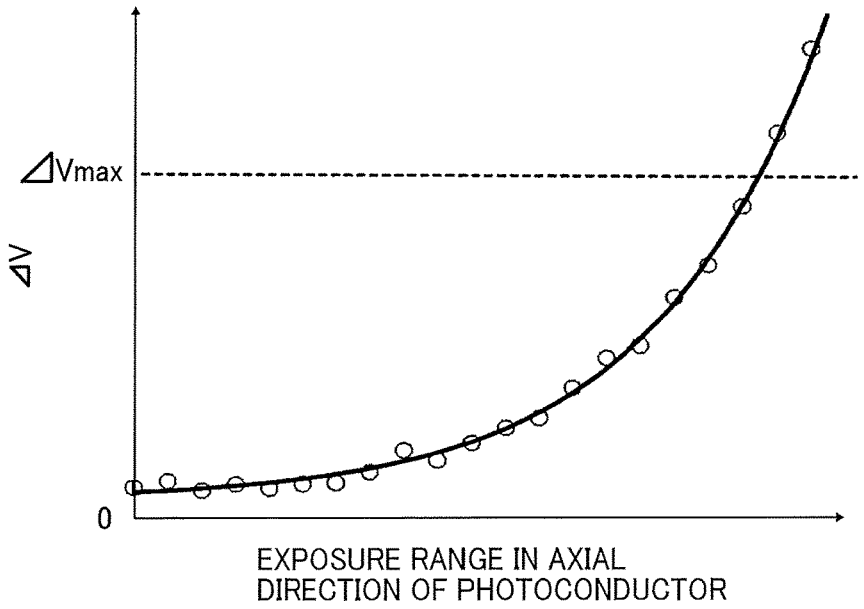
FIG. 3 is a graph illustrating an example of a relation between an exposure range at a first rotation in an axial direction of the photoconductor and the standard difference value ΔV in a standard usage environment and under standard usage conditions.

FIG. 3 is a graph illustrating an example of a relation between the exposure range at the first rotation in the axial direction of the photoconductor 2 and the standard difference value ΔV in the standard usage environment and under the standard usage conditions.

As illustrated in FIG. 3, the difference value ΔV that is an index value indicating likelihood of occurrence of the afterimage depends on the exposure range in the axial direction of the photoconductor 2. When the exposed area and the unexposed area exist in the axial direction, in a transfer process, a transfer current flowing from the transfer device 6 to the photoconductor 2 is distributed to the exposed area and the unexposed area. A distribution ratio of the transfer current varies depending on the size of the exposure range in the axial direction.

Because the transfer condition affects the difference value ΔV that is the index value indicating likelihood of occurrence of the afterimage, variation of the transfer current distributed to the exposed area and the unexposed area in the axial direction means variation of the difference value ΔV that is the index value indicating likelihood of occurrence of the afterimage.

Therefore, the processor 13 can evaluate how the afterimage depends on the exposure range in the axial direction as follows. The exposure device 4 changes the exposure ranges at the first rotation in the axial direction of the photoconductor 2 and makes a plurality of the exposure ranges. The surface voltmeters obtain the plurality of the surface potential VI and the surface potential V2, respectively. The processor 13 calculates the difference values ΔV corresponding to the plurality of the exposure ranges.

Similarly, when the surface voltmeters measure the surface potential V1 and the surface potential V2, respectively, a charging condition of the charger 3 can be arbitrarily set. That is, the charging condition may be different from the charging condition during image formation. A specific example of setting the charging condition is setting the charger 3 to charge the charge area on the surface of the photoconductor 2 that has passed the transfer region without applying a transfer bias at a surface potential of −600 V when the cumulative number of rotations n of the photoconductor 2 is zero. The surface potentials V1 and V2 are always measured under this charging condition. Another example of setting the charging condition is setting the charger 3 at every measurement of the surface potentials V1 and V2 to charge the charge area on the surface of the photoconductor 2 that has passed the transfer region without applying a transfer bias at the surface potential of −600 V before the surface potentials V1 and V2 are measured.

The notification device 15 notifies the result of the lifetime determination or the lifetime prediction of the photoconductor 2 from the processor 13. Therefore, a user of or a field technician (e.g., a service engineer) for the image forming apparatus 1 can replace the photoconductor 2 at a suitable timing. Furthermore, because the user or the field technician receives the notification of the lifetime prediction of the photoconductor 2, the user or the field technician can order a replacement for the photoconductor 2 in advance, before the life of the photoconductor 2 comes to its end. In addition, even when the user cannot replace the photoconductor 2, the field technician efficiently makes a visiting appointment because the field technician is notified of the lifetime prediction results. Therefore, the down time of the image forming apparatus 1 is reduced, thereby improving productivity.

Lifetime Determination and Lifetime Prediction

Figure 4:
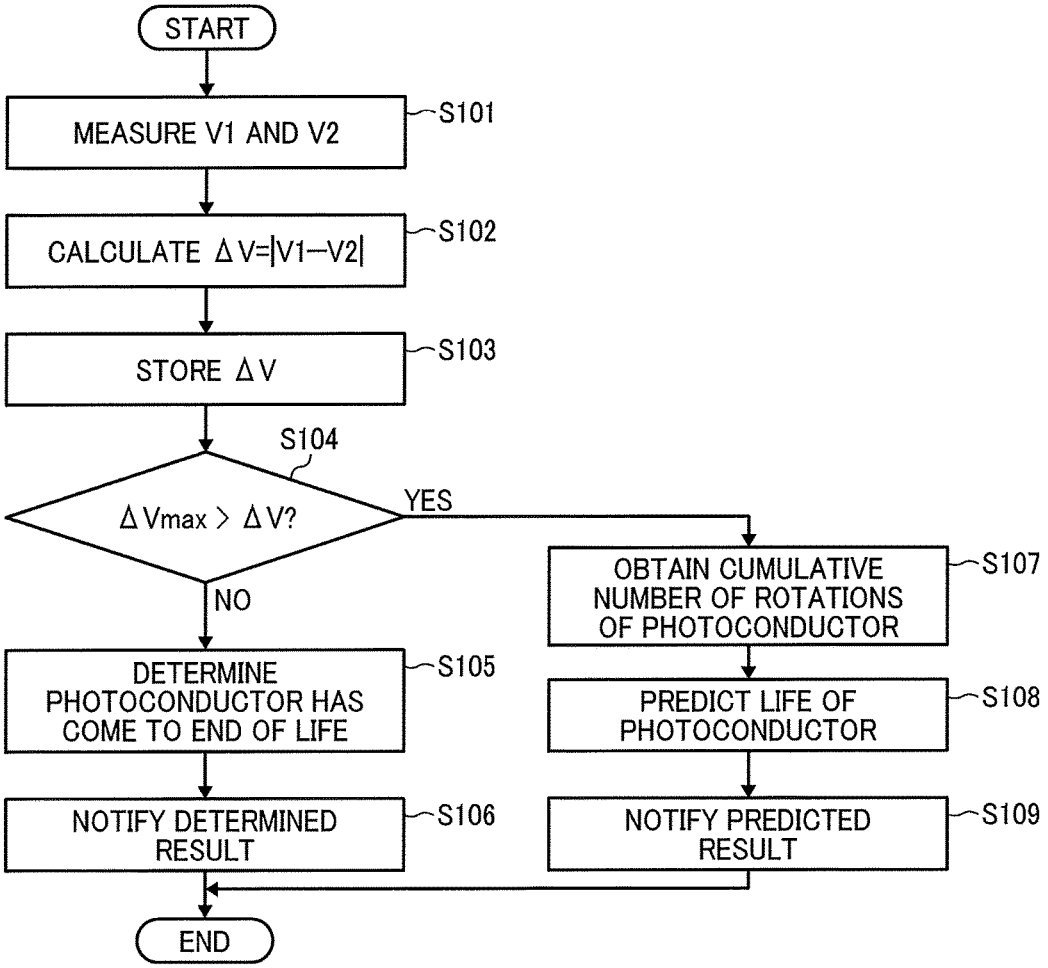
FIG. 4 is a flow chart of an example of a life expectancy prediction.

Processes of the lifetime determination of the photoconductor 2 and the lifetime prediction of the photoconductor 2 (hereinafter called a life expectancy prediction), which are performed by the processor 13, are described in detail. FIG. 4 is a flow chart illustrating an example of the life expectancy prediction.

In the life expectancy prediction, as described above, the surface voltmeters firstly measure the surface potential V1 and the surface potential V2, respectively, at the predetermined timing such as the start of the print job (step S101).

Subsequently, the processor 13 obtains the measured surface potential V1 and the measured surface potential V2, and calculates the absolute value of the difference value ΔV between the surface potential V1 and the surface potential V2 (that is, $\Delta V=|V1-V2|$) (step S102). The processor 13 stores the calculated difference value ΔV in memory 14 (step S103)

Next, the processor 13 compares the difference value ΔV and the reference value for life determination ΔVmax, which is set as a threshold value beforehand to determine the life of the photoconductor 2, and determines whether the difference value ΔV is equal to or greater than the reference value for life determination ΔVmax (step S104). A preferable setting example of the reference value for life determination ΔVmax is described below. The reference value for life determination ΔVmax depends on the transfer condition and a layer structure of the photoconductor 2. The preferable reference value for life determination ΔVmax is, for example, 5 V. An image density difference representing the afterimage tends to depend on the difference value ΔV. Generally, the difference value ΔV less than 5 V does not cause a problem of the afterimage, but, when the difference value ΔV becomes greater than or equal to 5 V, the afterimage is not ignorable.

When the processor 13 determines that the difference value ΔV is greater than or equal to the reference value for life determination ΔVmax (NO in step S104), the processor 13 determines that the photoconductor 2 has come to the end of life in step S105. Next, the notification device 15 notifies the determined result that informs the end of life of the photoconductor 2 on the control panel of the image forming apparatus 1 or the like in step S106.

On the other hand, when the processor 13 determines the difference value ΔV is smaller than the reference value for life determination ΔVmax (YES in step S104), the photoconductor 2 has not come to the end of life. Therefore, the processor 13 predicts the time when the photoconductor 2 will come to the end of life as described below. In the lifetime prediction, the processor 13 firstly obtains the cumulative number of rotations n of the photoconductor 2 at a time when the surface voltmeters measure the surface potential V1 and the surface potential V2, respectively, in step S107.

Next, the processor 13 refers to the aging variation data illustrated in FIG. 2 of the standard difference values ΔV that are measured until the photoconductor 2 has come to the end of life, and stored in the memory 14, and calculates the cumulative number of rotations of the photoconductor 2 at a time when the standard difference values ΔV become the reference value for life determination ΔVmax, which is called a cumulative number of rotations of the photoconductor life. The calculated cumulative number of rotations of the photoconductor life becomes a predicted value that means the time when the photoconductor 2 will come to the end of life.

Subsequently, in step S108, the processor 13 calculates remaining life of the photoconductor 2 as a number of printouts based on the calculated cumulative number of rotations of the photoconductor life and the cumulative number of rotations n of the photoconductor obtained in step S107.

Subsequently, the notification device 15 notifies the calculated result (predicted remaining life) to the control panel or the like of the image forming apparatus 1 in step S109.

The difference value ΔV tends to rise according to the deterioration of the photoconductor 2, but does not necessarily increase at a fixed rate with respect to the increase of the cumulative number of rotations of the photoconductor 2. For example, as in the example illustrated in FIG. 2, the difference value ΔV tends to increase exponentially with respect to the cumulative number of rotations of the photoconductor 2 in some cases. There is also a case where the difference value ΔV tends to decrease with respect to the cumulative number of rotations of the photoconductor 2.

Therefore, in the development stage of the image forming apparatus 1, the aging variation data obtained from data of the standard difference values ΔV that indicate how the difference value ΔV changes as the increase of the cumulative number of rotations of the photoconductor 2 until the photoconductor 2 has come to the end of life is investigated. More accurate lifetime determination and life prediction can be realized by the lifetime determination and life prediction of the photoconductor 2 based on the aging variation data.

For example, from data of the difference value ΔV measured with time in the past, the slope of the difference value ΔV against the cumulative number of rotations of the photoconductor 2 is calculated. By comparing the calculated slope with the extrapolation prediction from the present using the aging variation data illustrated in FIG. 2 in the memory 14 or slope data of the difference value ΔV against the cumulative number of rotations of the photoconductor 2 preliminarily obtained and the predetermined, reference value for life determination ΔVmax, the remaining life of the photoconductor 2 that means how many sheets can be printed before the end of life can be determined.

Process Cartridge

The processor 13 to evaluate the life of the photoconductor 2 is installed in the image forming apparatus 1. However, in the image forming apparatus 1 employing a process cartridge, the processor 13 may be installed in either the process cartridge or a body of the image forming apparatus 1.

Figure 5:
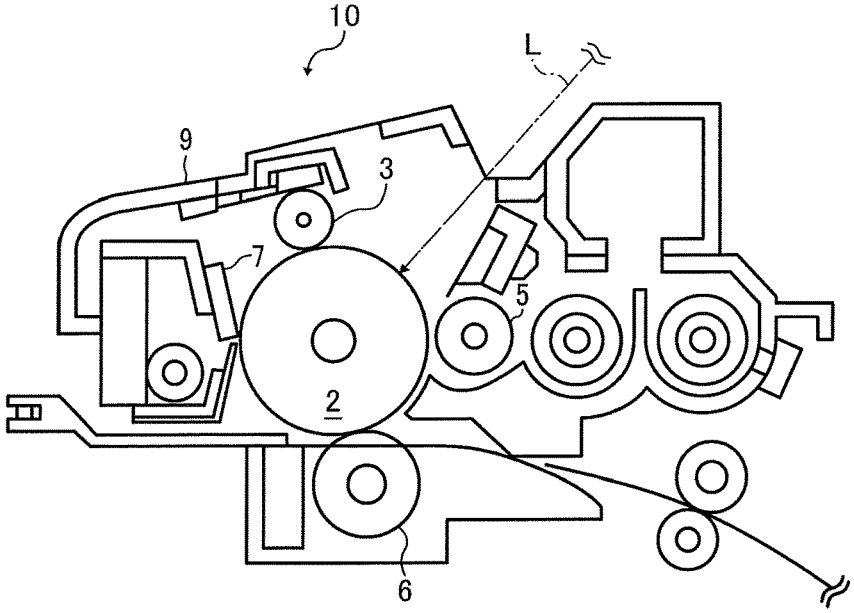
FIG. 5 is a schematic view illustrating an example of a process cartridge.

FIG. 5 illustrates an example of a process cartridge 10. The process cartridge 10, for example, accommodates the photoconductor 2, includes at least one of the charger 3, the exposure device 4, the developing device 5, the transfer device 6, the cleaning device 7, the discharger 8, the first surface voltmeter 11, and the second surface voltmeter 12. The photoconductor 2 and at least one of them are supported together by a support member 9. The process cartridge 10 is detachably attached to the body of the image forming apparatus 1.

As described above, the image forming apparatus 1 according to the first embodiment, at the arbitrary timing, at the first rotation of the photoconductor 2, charges the charge area on the photoconductor 2, exposes a part of the exposure area on the photoconductor 2 in the axial direction, and executes transfer process on an exposed area and an unexposed area on the photoconductor 2 in the axial direction of the photoconductor 2. At the second rotation of the photoconductor 2, the image forming apparatus 1 charges the charge area on the photoconductor 2 in the axial direction and exposes the exposure area on the photoconductor 2. After the exposure at the second rotation, two surface voltmeters provided in the same axial direction measure the surface potential V1 at the position where the photoconductor 2 is not exposed at the first rotation and the surface potential V2 at the position where the photoconductor 2 is exposed at the first rotation.

The processor 13 calculates the difference value ΔV (=|(V1−V2)|) which is a comparison value between the surface potentials V1 and V2, and evaluates the life of the photoconductor 2 based on the comparison value. The difference value ΔV is an index value indicating the degree of deterioration in image quality due to the afterimage occurring in the axial direction of the photoconductor 2, and makes it possible to perform the lifetime determination and the lifetime prediction of the photoconductor 2 accurately which is determined by the occurrence of the afterimage occurring in the axial direction of the photoconductor 2

The lifetime prediction by referring to the aging variation data that indicates the change with time of the difference value ΔV until the photoconductor 2 wears out and reaches the end of life makes it possible to predict the lifetime with high accuracy even if the transition (change over time) of the difference value ΔV in the image forming apparatus 1 indicates a peculiar change over time.

While varying the range of the exposure in the axial direction of the photoconductor 2 during exposure of the photoconductor 2 at the first rotation thereof, measuring the surface potentials V1 and V2 and calculating the difference value ΔV make it possible to determine the life of the photoconductor 2 due to the occurrence of the afterimage in the axial direction of the photoconductor 2 appropriately even when the exposure range in the axial direction is changed.

Notification of the fact that the photoconductor 2 has reached the end of life or the prediction result of the time when the photoconductor 2 will reach the end of life makes it possible to prompt the user or the field technician to prepare for photoconductor replacement and to reduce the downtime.

Second Embodiment

An image forming apparatus of the second embodiment according to the present disclosure is described below. It should be noted that description of the same points as in the first embodiment is omitted.

In the first embodiment, the monochrome image forming apparatus 1 having one photoconductor 2 is described, but the present disclosure is similarly applied to a so-called tandem-type color image forming apparatus having a plurality of photoconductors 2. In the second embodiment, an example of application to the tandem-type color image forming apparatus is described.

Figure 6:
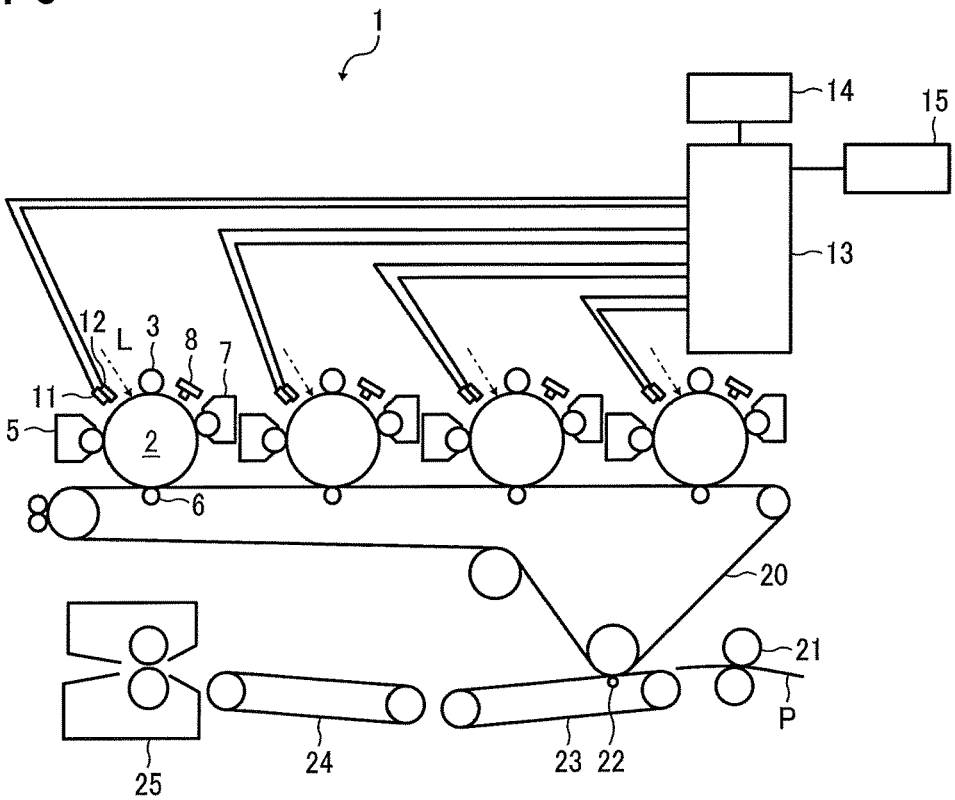
FIG. 6 is a schematic view of an image forming apparatus according to a second embodiment.

FIG. 6 is a schematic view illustrating the example of the tandem-type color image forming apparatus 1 according to the second embodiment. The image forming apparatus 1 illustrated in FIG. 6 uses toner of different colors (for example, yellow (Y), magenta (M), cyan (C), and black (K)) to form toner images of respective colors, and primarily transfers these toner images so as to overlap on the intermediate transfer belt 20 which is an intermediate transfer member.

The color toner images superimposed on the intermediate transfer belt 20 are secondarily transferred onto the transfer sheet P fed by the pair of registration rollers 21 in the secondary transfer region opposed to the secondary transfer roller 22. The transfer sheet P on which the color toner image is secondarily transferred is conveyed while being carried on the surfaces of the transfer belt 23 and the conveyance belt 24. The toner image is fixed on the transfer sheet P by application of heat and pressure in the fixing device 25, and the transfer sheet P is discharged from the image forming apparatus 1.

In the tandem type color image forming apparatus 1 as illustrated in FIG. 6, since each color image forming uses one photoconductor 2, the tandem type color image forming apparatus 1 includes a plurality of photoconductor 2. Generally, usage of each color depends on contents of output images. Therefore, repeating image formation of various contents of output image results in different deterioration speed of each photoconductor 2 in each color. The different deterioration speed among the photoconductor 2 results in a different life expectancy of the photoconductor 2, i.e., different timing of replacement of the photoconductor 2. Therefore, it is necessary to perform the lifetime determination and the lifetime prediction of the photoconductor 2 in each of photoconductors 2.

Replacing the deteriorated photoconductor 2 with the new photoconductor 2 every time the life of each photoconductor comes in each color increase a frequency of photoconductor replacement work in the image forming apparatus 1 and burden on users and field technicians.

In the image forming apparatus 1 according to the present embodiment, the replacement timings of all the photoconductors 2 are made to be substantially the same as each other by executing a determination process of photoconductor exchange described below. As a result, it is possible to replace all the photoconductors 2 with new ones at once. It is to be noted that the photoconductors 2 of the image forming apparatus 1 are interchangeable.

Determination Process of Photoconductor Exchange

Figure 7:
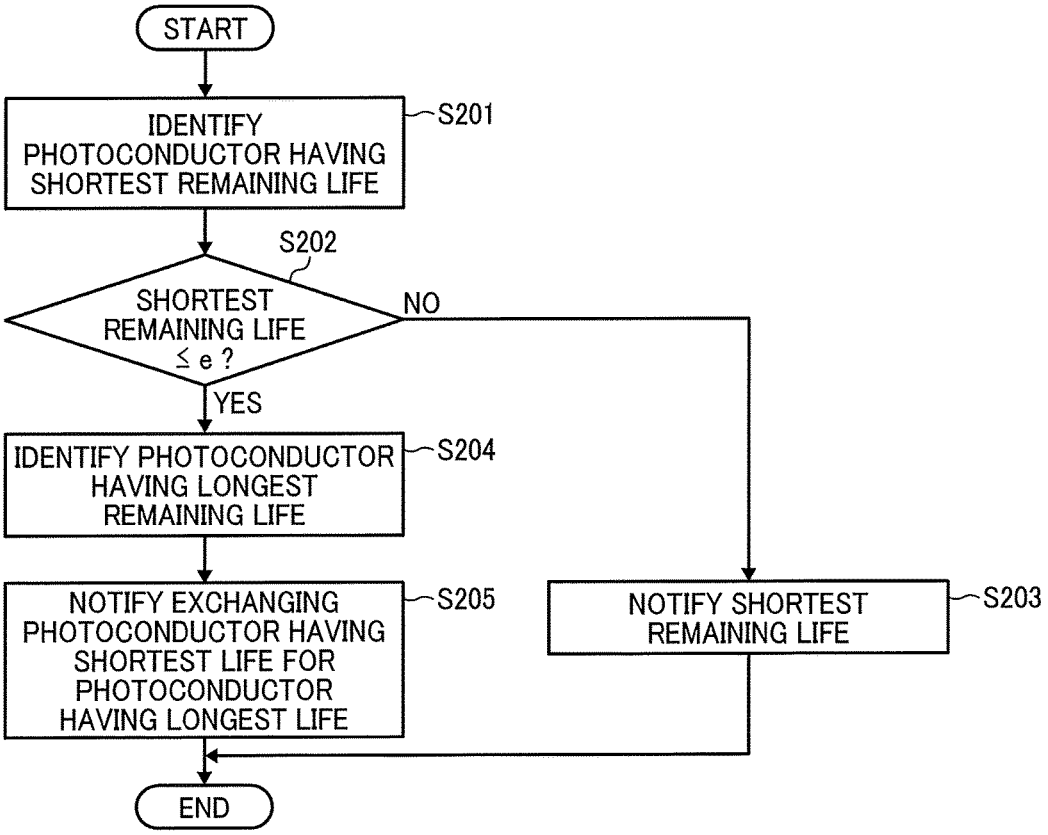
FIG. 7 is a flowchart illustrating steps in a process of determining photoconductor exchange in the second embodiment.

FIG. 7 is a flowchart illustrating an example of the process of determining photoconductor exchange. First, for each of the four photoconductors 2, the processor 13 executes the above-described life expectancy prediction (FIG. 4).

When the difference value ΔV is smaller than the reference value for life determination ΔVmax for each of all the photoconductors 2 in step S104 of the life expectancy prediction (FIG. 4) (YES in step S104), for all the photoconductors 2, the processor 13 executes steps S107 and S108 to calculate the remaining life of each photoconductor 2. After step S108, the processor 13 executes steps of the determination process of photoconductor exchange illustrated in FIG. 7 instead of step S109 of the life expectancy prediction.

In the determination process of the photoconductor exchange, in step S201, the processor 13 firstly identifies the photoconductor 2 having the shortest remaining life based on the remaining life of each photoconductor 2 calculated from the predicted value that means when the photoconductor 2 will reach the end of life in step S108 of the life expectancy prediction.

Next, the processor 13 compares the remaining life of the photoconductor 2 having the shortest remaining life with a specific value e that is a threshold value set before the end of life, and determines whether the shortest remaining life of the photoconductor 2 is the specific value e or less in step S202.

When the remaining life of the photoconductor 2 having the shortest remaining life exceeds the specific value e (NO in step S202), the notification device 15 displays the calculation result (the remaining life of the photoconductor 2 having the shortest remaining life) on the control panel or the like of the image forming apparatus 1 in step S203. At this time, the processor 13 may inform the determination result of the remaining life of each photoconductor 2.

On the other hand, when the remaining life of the photoconductor 2 having the shortest remaining life is equal to or less than the specific value e (YES in step S202), the processor 13 identifies the photoconductor 2 having the longest remaining life based on the remaining life of all photoconductors 2 in step S204.

Subsequently, in step S205, the notification device 15 notifies the control panel or the like a display prompting to exchange the photoconductor 2 having the shortest remaining life identified in step S201 for the photoconductor 2 having the longest remaining life identified in step S204. The notification device 15 may perform the notification in step S205 only when the remaining life difference between the photoconductor 2 having the shortest remaining life and the photoconductor 2 having the longest remaining life is equal to or greater than a specified value.

As described above, in the second embodiment, in the tandem-type color image forming apparatus 1, the processor 13 determines the remaining life of each photoconductor 2 after being used for a certain period under the actual usage environment and usage conditions, and grasps the relative degradation speed for each color under the actual usage environment and usage conditions.

Until the remaining life of the photoconductor 2 having the shortest remaining life exceeds the specific value e, the notification device 15 notifies contents prompting exchange between the photoconductor 2 having the shortest remaining life and the photoconductor 2 having the longest remaining life at a predetermined timing.

The user or the field technician who receive this notification can exchange the photoconductor 2 having the shortest remaining life for the photoconductor 2 having the longest remaining life. After this exchange, the photoconductor 2 having the longest remaining life is used in the process cartridge for a color with the earliest degradation speed, and the photoconductor 2 having the shortest remaining life is used in the process cartridge for color with the slowest degradation speed.

As a result, use of the image forming apparatus 1 for a certain period after the exchange decreases the remaining life difference between the photoconductor 2 having the shortest remaining life and the photoconductor 2 having the longest remaining life. Therefore, compared with the case where such exchange is not performed, it is possible to bring the remaining lives of all the photoconductors 2 closer to each other. This reduces waste of exchanging the photoconductor 2 having a long remaining life, makes it possible to exchange all the photoconductors 2 at once. Further, repeating this determination process of the photoconductor exchange makes it possible to adjust the time when the photoconductors 2 comes to the end of life at substantially the same time. All the photoconductor 2 can be collectively used in a less wasteful manner. Exchanging all the photoconductors at once becomes possible.

Above described image forming apparatus 1 according to the second embodiment is the tandem-type color image forming apparatus 1 having a plurality of photoconductors 2, and can execute the life determination of each photoconductor 2. Therefore, the lifetime determination and the lifetime prediction based on the deterioration speed of each photoconductor become possible.

A plurality of photoconductors 2 mean two or more interchangeable photoconductors 2. At a predetermined timing before the end of life of the photoconductor 2 that is predicted the smallest remaining life of all the photoconductors, notification prompting exchange between the photoconductor 2 that is predicted the smallest remaining life and the photoconductor 2 that is predicted the longest remaining life, as a result, makes it possible to use the photoconductor 2 in a less wasteful manner and exchange a plurality of photoconductors 2 at once.

Third Embodiment

As described above, the photoconductor 2 used in the image forming apparatus 1 deteriorates due to various kinds of damage during repeated image formation. In addition, the photoconductor 2 is also damaged by, for example, abrupt environmental changes (changes in temperature and/or humidity), adherence of discharge products remaining in the apparatus, and the like. Due to such damage, the deterioration state of the photoconductor 2 largely deviates from the normal transition of deterioration of the photoconductor, and abruptly advances in some cases.

Such an abrupt deterioration of the photoconductor 2 may be reversed by performing the image forming operation, a refreshing operation, or the like. The refreshing operation is, for example, to scrape the surface of the photoconductor with a cleaning blade.

Execution of the life expectancy prediction of the photoconductor 2 using the difference value ΔV based on the measurement of the surface potential under the abrupt deterioration of the photoconductor 2 causes a false determination, that is, a premature determination that the photoconductor reaches the end of life, and a large error regarding the calculation of the remaining life of the photoconductor.

The third embodiment makes it possible to perform the lifetime determination and the lifetime prediction accurately under the abrupt deterioration of the photoconductor 2.

Figure 8:
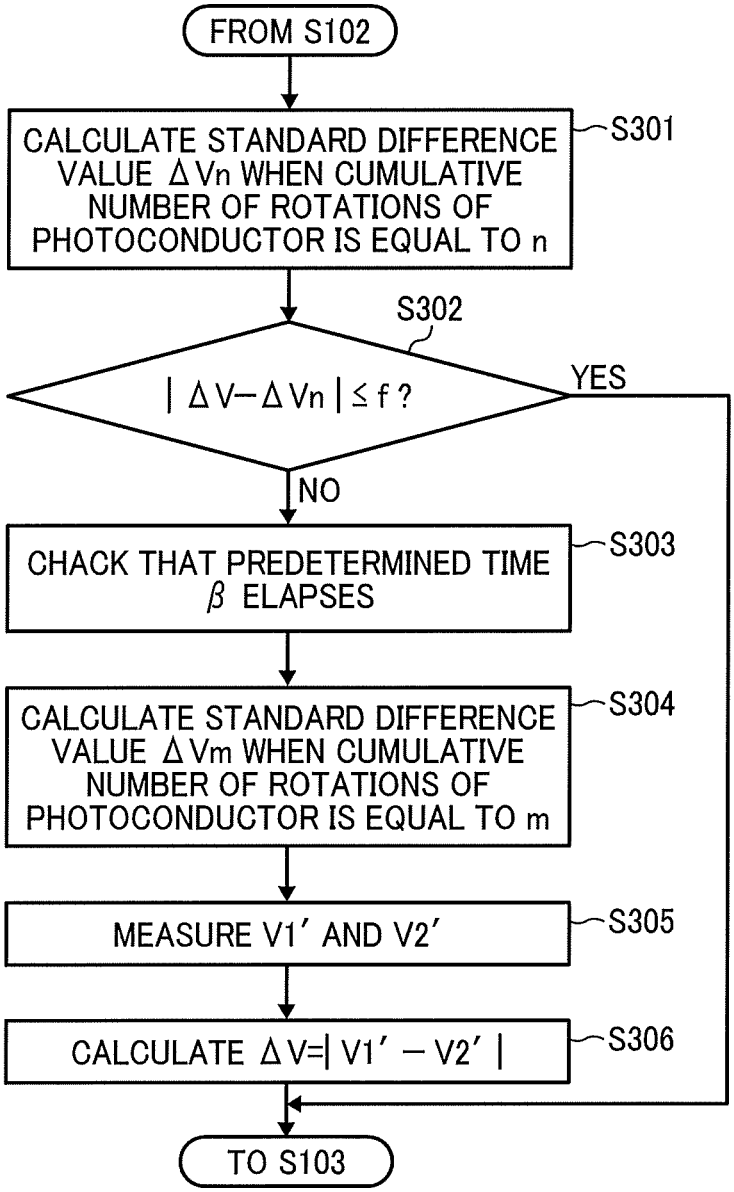
FIG. 8 is a flow chart illustrating an example of an additional process in the life expectancy prediction.
Figure 9:
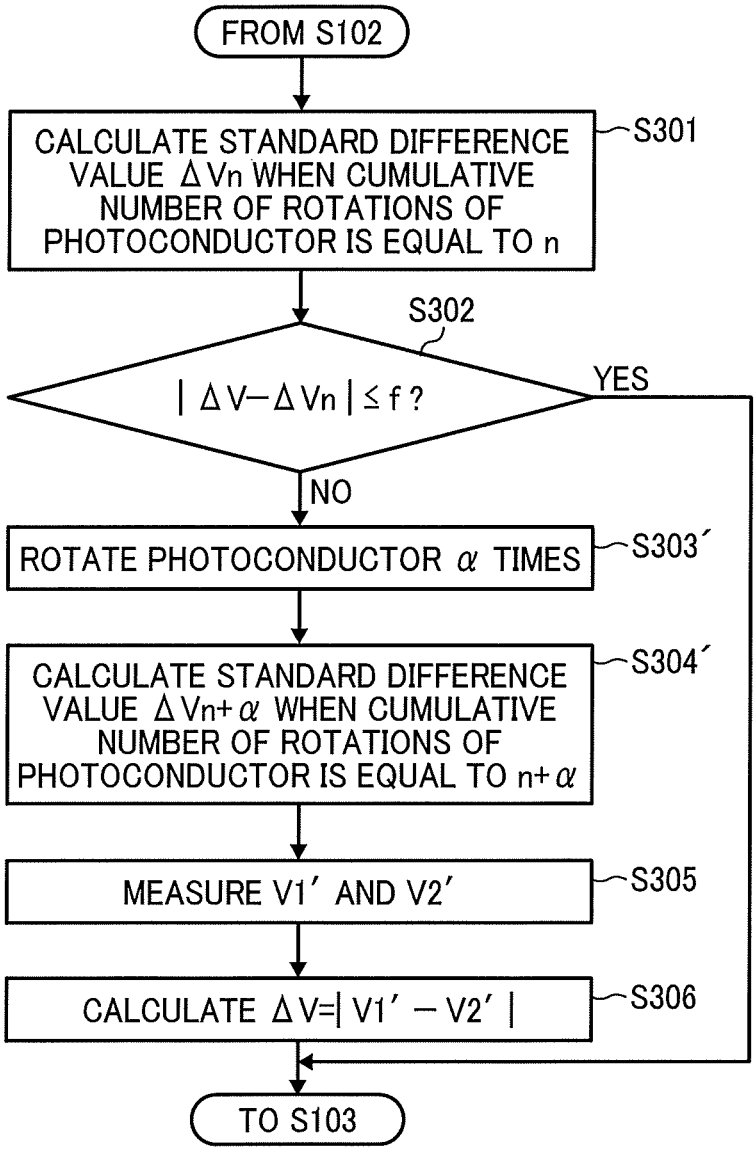
FIG. 9 is a flow chart illustrating another example of an additional process in the life expectancy prediction.

FIG. 8 and FIG. 9 are flowcharts illustrating an example of additional process in the life expectancy prediction. The processor 13 executes this addition process between step S102 and step S103 of the life expectancy prediction.

The additional process illustrated in FIG. 8 is described. After calculating the difference value ΔV in step S102 of the life expectancy prediction, in step S301, the processor 13 firstly refers to the aging variation data in the memory 14, and calculates the standard difference value ΔVn corresponding to the cumulative number of rotations of the photoconductor n at the time when the surface potential V1 and the surface potential V2 are measured.

Next, the processor 13 calculates a difference (|ΔV−ΔVn|) between the difference value ΔV and the standard difference value ΔVn, and compares the calculation result with a setting value f which is a preset threshold value in step S302.

When the difference |ΔV−ΔVn| is smaller than or equal to the setting value f (YES in step S302), processor 13 determines that no sudden change due to the deterioration of the photoconductor 2 occurs. In this case, the processor 13 advances the process to step S103 of the life expectancy prediction, stores the difference value ΔV calculated in step S102 in the memory 14, and performs lifetime determination and lifetime prediction based on the difference value ΔV.

On the other hand, when the difference |ΔV−ΔVn| is greater than the setting value f (NO in step S302), it is considered that the sudden change due to the deterioration of the photoconductor 2 occurs. In this case, after a predetermined time (time β) elapses in step S303, the processor 13 refers to the aging variation data in the memory 14, and calculates the standard difference value ΔVm corresponding to the cumulative number of rotations of the photoconductor m (m=n+α) obtained by adding a number of rotation of the photoconductor α in which the photoconductor 2 rotates by the time β elapses with respect to the cumulative number of rotations of the photoconductor n at the previous measurement in step S304.

After the processor 13 calculates the standard difference value ΔVm, in step S305, when the cumulative number of rotations of the photoconductor is m, the charger 3 charges the entire portion of the photoconductor 2 in the axial direction of the photoconductor 2, and exposure device 4 exposes a part of the photoconductor 2 in the axial direction. Subsequently, the transfer device 6 executes transfer process on the entire portion of the photoconductor 2 in the axial direction of the photoconductor 2. When the cumulative number of rotations of the photoconductor is (m+1), the charger 3 charges the entire portion of the photoconductor 2 in the axial direction, and the exposure device 4 exposes the entire portion of the photoconductor 2 in the axial direction. After the exposure, the first surface voltmeter 11 measures the surface potential V1' at the position where the photoconductor 2 is not exposed when the cumulative number of rotations of the photoconductor is m, and the surface potential V2' at the position where the photoconductor 2 is exposed when the cumulative number of rotations of the photoconductor is m. The positions at which the surface potentials V1' and V2' are measured may be the same as or different from the positions at which the surface potentials V1 and V2 are measured.

Next, the processor 13 calculates the difference value ΔV=(V1'−V2')| from the surface potentials V1', V2' in step S306, and stores the difference value ΔV in the memory 14 in step S103.

In this case, in the subsequent steps of the life expectancy prediction, using the difference value ΔV calculated in step S306, the processor 13 performs the lifetime determination and the lifetime prediction.

In addition, in the additional process illustrated in FIG. 8, processor 13 calculates the standard difference value ΔVm after an elapse of the predetermined time (time β) when the difference |ΔV−ΔVn| is greater than the setting value f in step S303, but, as illustrated in another example in FIG. 9, the processor 13 may calculate the standard difference value ΔVn+α in step S304' after the photoconductor 2 rotates a predetermined number of rotations (α rotations) in step S303'. The other processes are the same as those in FIG. 8.

The cumulative number of rotations of the photoconductor n in the additional process is a natural number, and the cumulative number of rotations of the photoconductor m is a natural number of n+2 or more. The predetermined number of rotations α is a natural number. Further, the predetermined time β is set to be equal to or longer than the time when the photoconductor 2 needs to recover from the temporary deterioration. The predetermined number a of rotation of the photoconductor 2 is the number of rotations of the photoconductor in which the photoconductor 2 needs to recover from the temporary deterioration. The values α and β are appropriately set values. This is because recovery may be performed for a short period by simply rotating the photoconductor 2 several times, or after a long period has elapsed or a certain number of rotations. When the recovery of the photoconductor 2 needs a long period of time or a certain number of rotations, refreshing process to recover the photoconductor 2 may be added, for example, the photoconductor 2 may be heated, or the photoconductor surface may be forcibly abraded by inputting toner to the photoconductor surface and rotating the photoconductor 2.

In addition, when the processor 13 calculates the difference between the difference value ΔV and the standard difference value ΔVn, and determines the calculation result is equal to or greater than a predetermined threshold value, the notification device 15 may notify situation of the photoconductor 2.

The image forming apparatus 1 according to the third embodiment described above identifies the standard difference value ΔV that is the reference comparison value corresponding to the time when the surface potentials VI and V2 used for calculating the difference value ΔV are measured based on the aging variation data. When the difference between the difference value ΔV and the identified difference value ΔVn is larger than the specified value f, surface potentials V1' and V2' are measured again after a predetermined time, time β, elapses, or after the photoconductor 2 rotates a times. The difference value ΔV between the surface potentials V1' and V2' is calculated, and the life of the photoconductor 2 is evaluated based on the difference value ΔV. Therefore, the image forming apparatus 1 according to the third embodiment can decrease an error of the lifetime determination and the lifetime prediction due to sudden measurement abnormality.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

at least one photoconductor being rotatable and having a surface including a charge area and an exposure area;

a charger to charge the charge area on the surface of the photoconductor;

an exposure device to form an electrostatic latent image on the exposure area on the surface of the photoconductor after the charger charges the charge area on the surface of the photoconductor;

a transfer device to transfer onto a recording medium a toner image obtained by developing the electrostatic latent image;

a first surface voltmeter to measure a first surface potential of the photoconductor;

a second surface voltmeter to measure a second surface potential of the photoconductor, the second surface voltmeter disposed at a position different from a position of the first surface voltmeter in an axial direction of the photoconductor; and a processor to control the photoconductor to be rotated at a predetermined timing, at a first rotation of the photoconductor, the processor causing:

the charger to charge the charge area, the exposure device to expose a part of the exposure area in the axial direction of the photoconductor, and the transfer device to charge an exposed area and an unexposed area on the photoconductor, at a second rotation of the photoconductor, the processor causing:

the charger to charge the charge area, and the exposure device to expose the exposed area and the unexposed area at the first rotation of the photoconductor, and after the exposure at the second rotation, the first surface voltmeter to measure the first surface potential of the unexposed area on the photoconductor at the first rotation, and the second surface voltmeter to measure the second surface potential of the exposed area on the photoconductor at the first rotation to evaluate a life of the photoconductor based on the first surface potential and the second surface potential.

2. The image forming apparatus according to claim 1, wherein the processor determines whether the photoconductor has reached an end of life according to a result of comparison between a predetermined threshold value and a difference value between the first surface potential and the second surface potential.

3. The image forming apparatus according to claim 2, wherein if the processor determines that the photoconductor has not reached an end of life, the processor predicts a time when the photoconductor will reach the end of life.

4. The image foiling apparatus according to claim 3, further comprising a memory to store preset aging variation data indicating a relation between a cumulative number of rotations of the photoconductor and a standard difference value, wherein the processor predicts the time when the photoconductor will reach the end of life based on the difference value and the preset aging variation data.

5. The image forming apparatus according to claim 2, further comprising:

a memory to store preset aging variation data indicating a relation between a cumulative number of rotations of the photoconductor and a standard difference value, wherein, when a difference between the difference value and the standard difference value of the preset aging variation data corresponding to the difference value is equal to or greater than a predetermined value, at a third rotation of the photoconductor after elapse of a predetermined time from an end of the second rotation of the photoconductor or after a predetermined number of rotations of the photoconductor from an end of the second rotation of the photoconductor, the processor causes:

the charger to charge the charge area; and the exposure device to expose a part of the exposure area in the axial direction of the photoconductor; and the transfer device to charge an exposed area and an unexposed area on the photoconductor, and at a fourth rotation of the photoconductor, the processor causes:

the charger to charge the charge area; and the exposure device to expose the exposed area and the unexposed area at the third rotation of the photoconductor, wherein, after the exposure at the fourth rotation, the processor causes the first surface voltmeter to measure the first surface potential of the unexposed area on the photoconductor at the third rotation, and the second surface voltmeter to measure the second surface potential of the exposed area of the photoconductor at the third rotation to evaluate the life of the photoconductor based on the first surface potential and the second surface potential measured at the fourth rotation of the photoconductor.

6. The image forming apparatus according to claim 1, wherein the processor evaluates the life of the photoconductor based on the first surface potential and the second surface potential that are measured while varying a range of the exposed area in the axial direction of the photoconductor at the first rotation of the photoconductor.

7. The image forming apparatus according to claim 1, wherein the at least one photoconductor includes:

a first photoconductor; and a second photoconductor; and wherein the processor evaluates a life of the first photoconductor separately from a life of the second photoconductor.

8. The image forming apparatus according to claim 1, further comprising a notification device to notify an evaluated result of the life of the photoconductor by the processor.

9. The image forming apparatus according to claim 8, wherein the at least one photoconductor includes a plurality of interchangeable photoconductors, and wherein the processor determines whether the plurality of interchangeable photoconductors reach ends of life according to a result of comparison between a predetermined threshold value and a difference value between the first surface potential and the second surface potential, and if the processor determines that the photoconductors do not reach ends of life, the processor predicts the time when the photoconductors will reach end of life;

determines which of remaining lives of the photoconductors is the shortest and which of remaining lives of the photoconductors is the longest; and causes the notification device to prompt exchanging between the photoconductor having the shortest remaining life and the photoconductor having the longest remaining life.

10. A photoconductor evaluation method for evaluating a photoconductor provided in an image forming apparatus, the photoconductor evaluation method comprising:

charging a charge area on a surface of the photoconductor to a first polarity at a first rotation of the photoconductor at a predetermined timing;

exposing a part of an exposure area in an axial direction of the photoconductor to form an electrostatic latent image after charging the charge area on the surface of the photoconductor;

charging an exposed area and an unexposed area of the exposure area to a second polarity that is opposite the first polarity;

charging the charge area on the surface of the photoconductor to the first polarity at a second rotation of the photoconductor;

exposing the exposed area and the unexposed area at the first rotation of the photoconductor;

measuring a first surface potential of the unexposed area on the photoconductor at the first rotation and a second surface potential of the exposed area on the photoconductor at the first rotation; and evaluating a life of the photoconductor based on the first surface potential and the second surface potential.

* * * * *